US005704731A

United States Patent [19]

Huang

[11] Patent Number: 5,704,731

[45] **Date of Patent: *Jan. 6, 1998**

[54] MULTIPURPOSE OFFSHORE MODULAR PLATFORM

[75] Inventor: Yen T. Huang, Dallas, Tex.

[73] Assignee: San Tai International Corporation, Dallas, Tex.

[ * ] Notice: The term of this patent shall not extend beyond the expiration date of Pat. No. 5,525,011.

[21] Appl. No.: 644,570

[22] Filed: May 10, 1996

Related U.S. Application Data

[63] Continuation-in-part of Ser. No. 418,545, Apr. 7, 1995, Pat. No. 5,525,011.

[51] Int. Cl.[6] ..... B63B 35/44

[52] U.S. Cl. ..... 405/223.1; 405/224; 114/264; 114/265

[58] Field of Search ..... 405/195.1, 200, 405/203–205, 219, 223.1, 224; 52/2.18; 114/264, 265, 266

[56] References Cited

U.S. PATENT DOCUMENTS

| | | | |
|---|---|---|---|
| 2,564,398 | 8/1951 | Eicholtz | 155/58 |
| 2,771,896 | 11/1956 | Call | 135/4 |
| 3,082,608 | 3/1963 | Daniell | 405/224 |
| 3,111,692 | 11/1963 | Cox | 9/8 |
| 3,154,039 | 10/1964 | Knapp | 114/5 |
| 3,327,780 | 6/1967 | Knapp et al. | 166/5 |
| 3,407,610 | 10/1968 | Wolff | 405/205 |
| 3,468,082 | 9/1969 | Hadley | 52/81 |

(List continued on next page.)

FOREIGN PATENT DOCUMENTS 438681 12/1967 Switzerland ..... E04H 11/06

OTHER PUBLICATIONS

Y. T. Huang, Conventional Roof, Unconventional Approach, Proceedings of the Third (1993) Int'l. Offshore and Polar Eng. Conf., Singapore, Jun. 11, 1993.

Y.T. Huang, Semi–Submerged Modular Offshore Platform, Proceedings of the Fourth (1994) Int'l. Offshore and Polar Eng. Conf., Osaka, Japan, Apr. 10–15, 1994.

T. Levstad, J. Namork and A. U. Nilsen, Features of a Taut Leg Mooring System for Deep Water, Proceedings of the Fifth (1995) Int'l. Offshore and Polar Eng. Conf., The Hague, The Netherlands, Jun. 11–16, 1995.

*Primary Examiner*—Tamara L. Graysay
*Assistant Examiner*—Frederick L. Lagman
*Attorney, Agent, or Firm*—Harold L. Novick; Nath & Associates

[57] ABSTRACT

Modular floating structures suitable for supporting offshore oil drilling and production platforms may be fabricated utilizing a Y-shaped joint interconnecting plural legs of a space frame. The space frame may be made up of plural frame members where each corner of the frame includes a Y-shaped joint. Stable offshore floating structures for drilling and production platforms may utilize the integral space frames in a truncated dodecahedral, inverted pyramid or tetrahedral configuration. The Y-shaped joint may be formed of three channel members each having opposed legs which may be secured to the opposed legs of the other channel members in a back-to-back or face-to-face configuration to form the Y-shaped joint. The channel members may be fabricated of flat plate folded and cut along predetermined lines to form the channel members. If the channel members are secured to each other face-to-face, they may form hollow flotation chambers suitable for use with the floating structures. Cylindrical tanks can be used as modular components. The Y-shaped joints may be easily fabricated on site or prefabricated and nested for ease of storage and transport. The Y-shaped joints may be formed as flexible inflatable members interconnected by coupling members to form a rigid floating structure. The Y-shaped joints and connecting leg portions may also be used to temporarily store fluids, such as crude oil, produced from subsea wells connected to the floating structures. The Y-shaped joints may be deflated for transportation of the structure on the sea.

23 Claims, 14 Drawing Sheets

U.S. PATENT DOCUMENTS

| | | | |
|---|---|---|---|
| 3,577,946 | 5/1971 | Horton | 114/0.5 |
| 3,596,950 | 8/1971 | Wipkink | 405/207 X |
| 3,665,882 | 5/1972 | Georgiev et al. | 114/266 |
| 3,934,528 | 1/1976 | Horton et al. | 405/223.1 X |
| 3,945,156 | 3/1976 | Hamm | 52/2 |
| 3,957,069 | 5/1976 | Denaro | 135/15 PE |
| 3,982,401 | 9/1976 | Loggins | 61/93 |
| 3,982,492 | 9/1976 | Steddum | 405/223.1 X |
| 3,983,706 | 10/1976 | Kalinowski | 61/98 |
| 4,000,585 | 1/1977 | Denaro | 52/2 |
| 4,113,206 | 9/1978 | Wheeler | 244/31 |
| 4,198,179 | 4/1980 | Pease et al. | 405/223.1 X |
| 4,288,947 | 9/1981 | Huang | 52/2 |
| 4,365,576 | 12/1982 | Cook | 405/200 |
| 4,437,794 | 3/1984 | Grimsley et al. | 405/224 |
| 4,554,883 | 11/1985 | Lane | 114/266 |
| 4,583,330 | 4/1986 | Huang | 52/2 |
| 4,633,566 | 1/1987 | Coppa | 29/429 |
| 4,702,648 | 10/1987 | Stageboe et al. | 405/224 |
| 4,783,936 | 11/1988 | Hujsak | 52/108 |
| 4,813,191 | 3/1989 | Huang | 52/167 |
| 4,875,806 | 10/1989 | Lindberg et al. | 405/224 |
| 4,903,452 | 2/1990 | Huang | 52/646 |
| 4,959,901 | 10/1990 | Parish | 52/2 K |

FIG.17
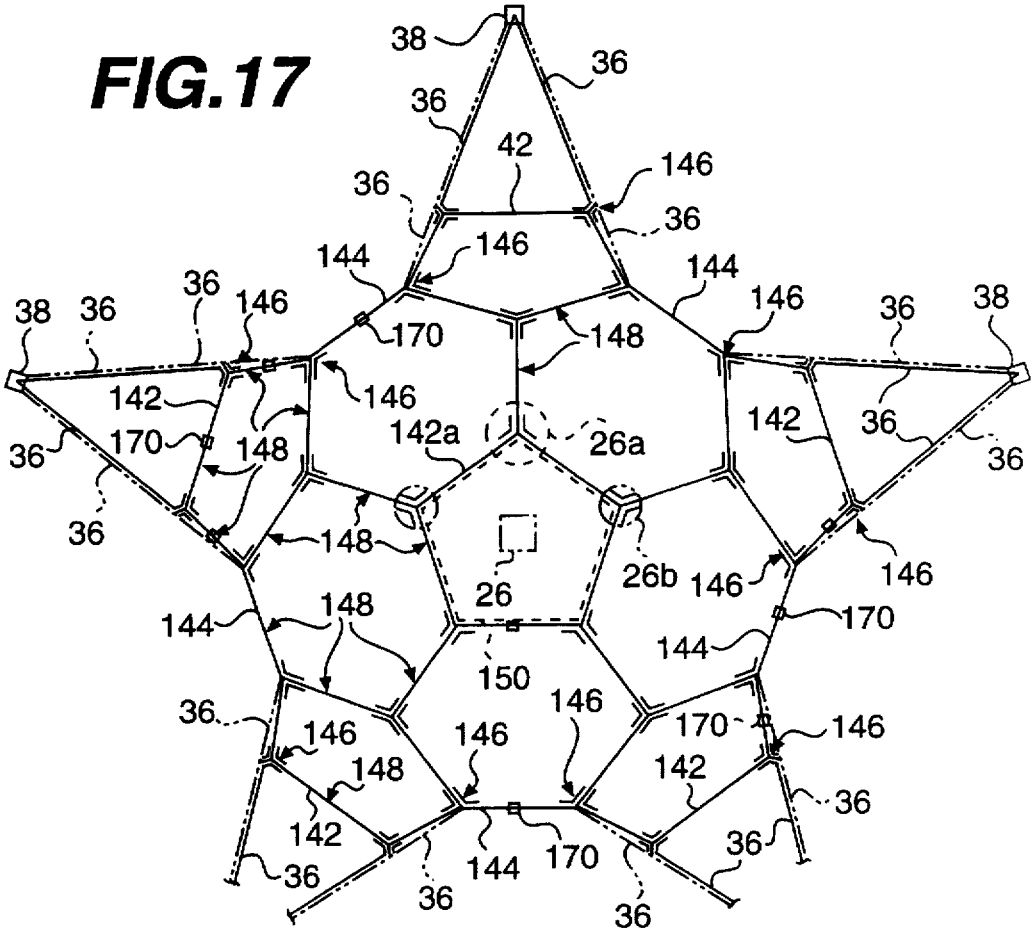
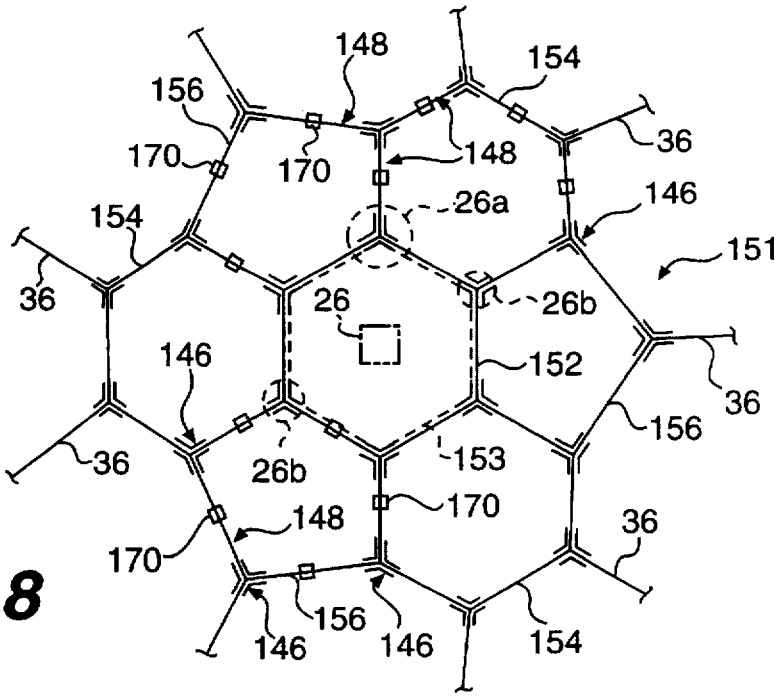
FIG.18

MULTIPURPOSE OFFSHORE MODULAR PLATFORM

CROSS-REFERENCE TO RELATED APPLICATIONS

This Application is a continuation in part of U.S. patent application Ser. No. 08/418,545 filed Apr. 7, 1995, now U.S. Pat. No. 5,525,011.

FIELD OF THE INVENTION

The present invention pertains to modular framed structures including inflatable floating structures, particularly useful for supporting offshore drilling and hydrocarbon production platforms and oil storage facilities, and roof structures, both utilizing a Y-shaped joint interconnecting leg or beam members of the structures, respectively.

BACKGROUND

The costs associated with providing suitable engineered structures for various applications, such as floating structures, including storage tanks, and roof structures for buildings of many types, continue to be a vexatious problem in the structural engineering arts. Unique solutions to these problems, in general, are described and claimed in my prior co-pending application Ser. No. 07/997,339 now U.S. Pat. No. 5,546,722, filed Dec. 28, 1992 and in my prior U.S. Pat. No. 4,288,947 issued Sep. 15, 1981; U.S. Pat. No. 4,583,330 issued Apr. 22, 1986; U.S. Pat. No. 4,813,191 issued Mar. 21, 1989 and U.S. Pat. No. 4,903,452 issued Feb. 27, 1990, as well as the invention described and claimed in the above-referenced prior, co-pending application, all incorporated by reference herein.

However, further improvements have been sought in the provision of certain structures which may utilize a Y-shaped joint such as described and claimed in the above-referenced patents and patent applications, which improvements are provided by the invention described hereinbelow.

One example of a complex and expensive structure which can benefit from the improvements of the present invention are certain types of floating, generally stationary structures used in the hydrocarbon development industry for drilling wells under large bodies of water, including the open oceans. Various types of floating drilling, production and service platforms have been constructed including, jack-up rigs, barges, submersible structures, semi-submersible type structures, tension leg structures, and free standing or the more conventional guyed towers. However, these structures could benefit from simplification and the modularity provided by the Y-joint and wherein the structural legs interconnecting a plurality of these joints may be modularized as flotation members. Particular configurations of floating support structures for offshore drilling and production platforms made up of a Y-joint in accordance with the invention and interconnecting leg portions are structurally uncomplicated, stable and are easily adapted for anchoring in the open sea by tension leg members or by conventional catenary anchor leg members, such as flexible chains, polyester taut cables or aramid ropes.

The problems associated with properly engineered and cost effective structures, such as roof structures, continue to daunt the structural engineering arts in that such roof structures, for example, should be simple, include a minimum number of structural members but be adequately configured to withstand all types of expected loads imposed thereon. With a view to simplifying the provision of a Y-joint for use as a roof or other structure joint member, including a joint member for the above-mentioned floating structures, I have developed certain improvements in the Y-joint which provide ease of fabrication, storage, transportation and erection to form any structure utilizing the joint in an improved manner. Those skilled in the art will further appreciate these improvements upon reading the below-discussed summary of the invention as well as the detailed description, drawings and claims hereof.

SUMMARY OF THE INVENTION

The present invention provides improved modular space frame structures and the like utilizing an improved Y-shaped component or joint member.

In accordance with one important aspect of the invention unique floating structures, particularly adapted for generally stationary placement offshore in the open ocean are provided which utilize a Y-joint in accordance with the invention and which are otherwise made up of leg members interconnecting the Y-joints which also serve as flotation and fluid storage members together with the Y-joints. The structures of the invention are particularly adapted for placement as tension leg anchored or catenary anchor leg anchored offshore structures used in drilling and producing hydrocarbons from subterranean reservoirs.

The present invention further provides plural embodiments of a unique offshore floating structure which is stable, compliant to movement due to high wave action or otherwise unwanted sea states or conditions, is easily fabricated at a shore-side yard or offshore and is also easily adapted for anchoring by tension leg or catenary anchor leg or taut anchor leg members.

The present invention further provides an improved Y-joint for use as a structural member in modular space frame structures, such as conventional pitched roofs or buildings of virtually any type wherein the Y-shaped joint may be fabricated from metal plate to form opposed branch members making up the Y-joint and wherein the branch members are formed as channels which may be interconnected back to back or facing each other to provide the improved Y-shaped joint.

The present invention still further provides an inflatable floatable structure made up of inflatable Y-shaped joints formed of flexible material, such as a fabric reinforced elastomeric material, such joints being interconnected by unique connector members.

The present invention further contemplates a method of making a Y-joint member utilizing plate members which may be cut and bent and interconnected in a unique manner.

Still further, the invention contemplates the provision of an improved roof structure for buildings of many types utilizing the improved Y-shaped joint of the present invention.

Those skilled in the art will further appreciate the above-mentioned features and advantages of the invention together with other superior aspects thereof upon reading the detailed description which follows in conjunction with the drawings.

BRIEF DESCRIPTION OF THE DRAWING

FIG. 17 is a top plan view in somewhat schematic form of a fifth alternate embodiment of a floating structure in accordance with the invention;

FIG. 18 is a top plan view in somewhat schematic form of a sixth alternate embodiment of a floating structure in accordance with the invention;

DESCRIPTION OF THE PREFERRED EMBODIMENTS

Figure 1:
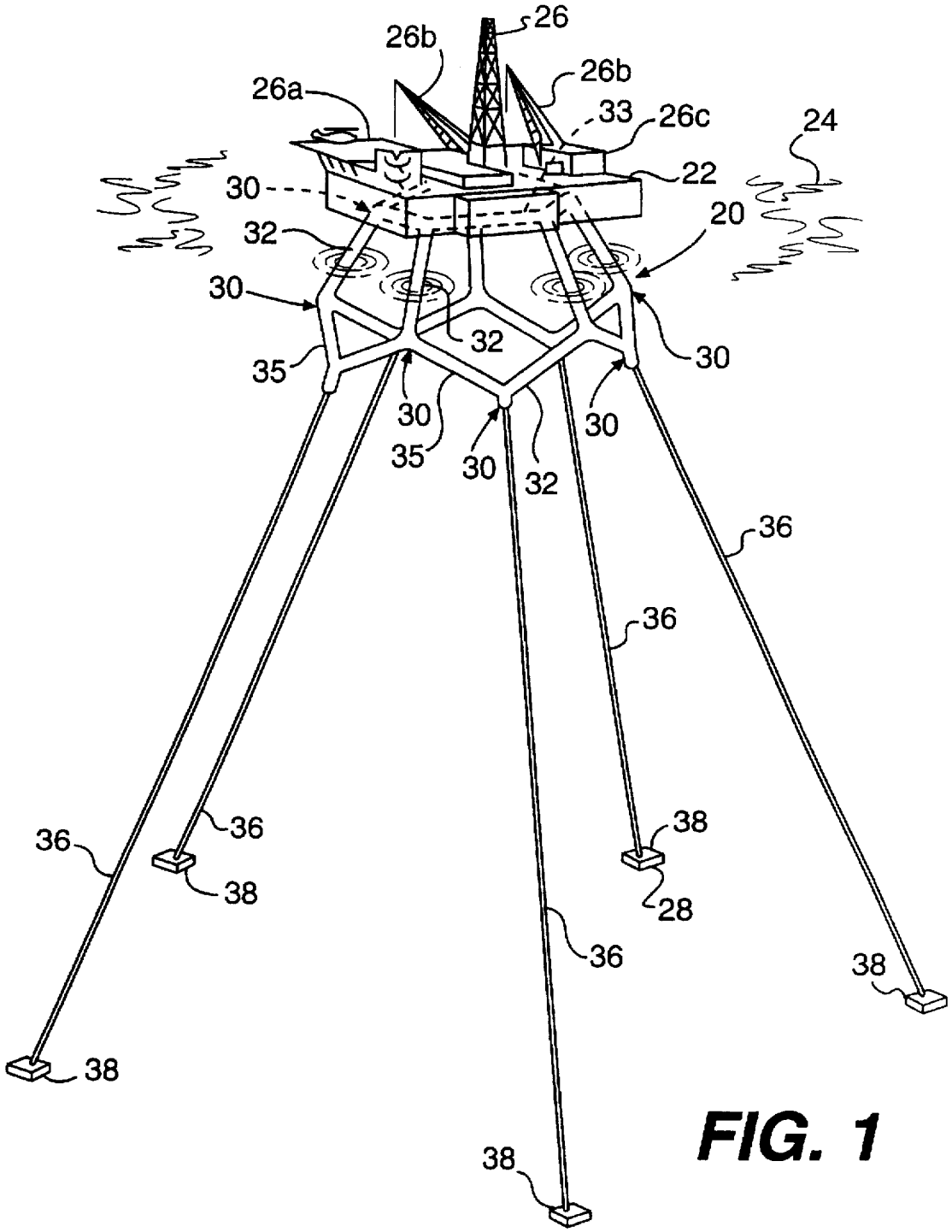
FIG. 1 is a perspective view of an improved floating structure in accordance with the invention for supporting an offshore well-drilling and/or hydrocarbon production platform in accordance with the invention.

In the description which follows like parts are marked throughout the specification and drawing with the same reference numerals, respectively. The drawing figures are not intended to be to scale and certain features and elements are shown in generalized or schematic form in the interest of clarity and conciseness.

Referring to FIG. 1 there is illustrated one unique structure in accordance with the present invention and generally designated by the numeral 20. The structure 20 comprises a floating structure, particularly adapted to support an offshore drilling and/or production platform, generally designated by a numeral 22 used for drilling and production of hydrocarbon fluids from subterranean reservoirs disposed beneath a body of water 24. In the particular embodiment shown the platform 22 is of generally rectangular configuration and includes a drill derrick 26, a helicopter landing deck **26*a*, cranes 26*b*, living quarters 26*c* and other conventional components supported on the platform for carrying out drilling of wells, not shown, through seabed 28**.

The problems associated with providing suitably engineered, cost effective and operable, generally stationary, floating structures which are stable and generally resistant to movement in unwanted sea states generated by high winds and ocean currents have been sought to be overcome by providing structures which have low resistance to wave action and wind and a center of gravity below a center of buoyancy. The floating structure 20, as well as alternate embodiments described below, satisfies these requirements and is characterized by a plurality of substantially rigid, generally Y-shaped joints 30 which are interconnected by leg members 32, see FIG. 2 also. In fact, the entire structure 20 except for platform 22 is made up of rigid Y-shaped joints 30 and interconnecting leg members 32, as indicated. A particular preferred embodiment of the structure 20 is one wherein the rigid Y-joints 30 each have arm portions, see FIGS. 3, **30*a*, 30*b* and 30*c* which are suitably connected to the legs 32 or are integrally formed therewith. In the embodiment of the Y-shaped joints 30 and legs 32 for the structure 20 the arm portions 30*a*, 30*b*, and 30*c* are generally cylindrical tubular members suitably formed of tubular metal or reinforced plastic segments joined to each other and to the leg members 32. The leg members 32** are also cylindrical tubes, as illustrated.

Figure 3:
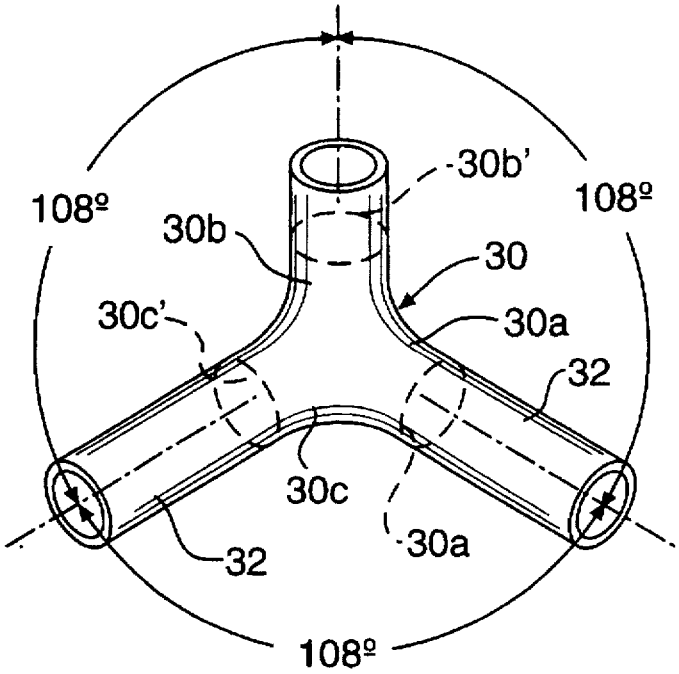
FIG. 3 is a detail view of one of the Y-shaped joints and a portion of the interconnecting leg portions of the structure shown in FIGS. 1 and 2.

A preferred embodiment of the structure 20 is one wherein the joint arm portions **30*a*, 30*b* and 30*c* extend away from each other at respective angles between any two arm portions of 108°, as indicated in FIG. 3. The Y-joint 30 and the structure 20 may be formed with angles between the joint arm portions other than that indicated in FIG. 3. However, the structure 20 if made up of pentagonal frames utilizing the Y-joints 30 and the interconnecting leg portions 32** may enjoy a high degree of modularity in that the structure is basically comprised of the above-mentioned elements all suitably interconnected, such as by welding.

Referring again to FIGS. 1 and 2, the structure 20 preferably includes a pentagonal space frame 33, which is disposed in a generally horizontal plane for supporting the platform 22, and five dependent space frames 35. As shown in FIG. 1, the lowermost joints 30 of space frames 35 include means for connecting the structure 20 to plural flexible catenary or taut anchor legs or lines 36, respectively. Each of the anchor lines 36 is connected to suitable anchor means 38 disposed on the seabed 28. Further discussion of determining a suitable length for the anchor lines 36 may be obtained from my publication entitled: "Semi-Submerged Modular Offshore Platform" presented at the International Offshore and Polar Engineering Conference, Osaka, Japan, Apr. 12, 1994.

Figure 4:
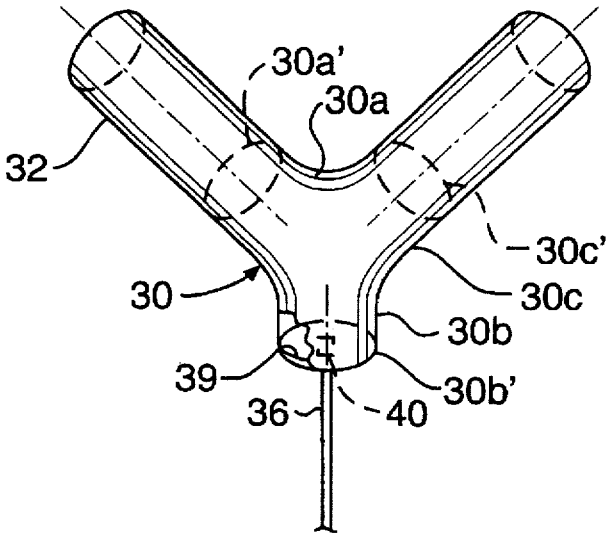
FIG. 4 is a detail view of another one of the joints of the structure shown in FIGS. 1 and 2.

FIG. 4 shows one of the Y-joints 30 provided with a suitable transverse closure plate 39 across the cylindrical arm portion 30b and forming a connecting point 40 for one of the anchor lines 36. Each of the lowermost Y-joints 30 which are connected to anchor lines 36 are configured as shown in FIG. 4 to have a watertight closure plate or bulkhead 39 disposed thereacross to close the tubular joint 30 and the legs 32 so that these elements may be used to form flotation chambers to provide requisite buoyancy for the structure 20. In fact, the Y-joints 30 and the legs 32 may be constructed in accordance with known methods for constructing floating offshore platforms, including tension leg-type platforms, as well as semi-submersible type platforms known to those skilled in the art.

However, an important advantage of the present invention resides in the provision of the modular, Y-joints 30 which may be prefabricated and erected with legs 32 either onshore or using suitable work barges and/or floating drydock structures and the like in calm anchorages for assembling the structure 20. The depending leg portions 32 of each of the space frames 35 may include suitable floodable compartments or ballast tanks for ballasting the structure 20 to maintain certain trim and freeboard conditions for the platform 22, depending on sea conditions. The legs 32 of the space frames 35 may also house certain equipment for the structure 20, such as pumps and associated piping for flooding and deballasting in the aforementioned compartments or ballast tanks, not shown. Those skilled in the art will recognize that the legs 32 and Y-joints 30 may be constructed in such a way that the branch arm portions 30a, 30b and 30c may be of various lengths to actually form part of or all of the legs 32. For example, each arm of the Y-joint 30 may comprise approximately half the total length of the leg 32 and the abutting ends of the aforementioned portions of the legs 32 may then be suitably secured together, such as by welding to form a water-tight tubular flotation structure. As shown in FIG. 3, each of the Y-joints 30 may terminate at a transverse face 30a', 30b' and 30c', for example and suitably welded at the juncture defined thereby to the tubular legs 32.

Figure 2:
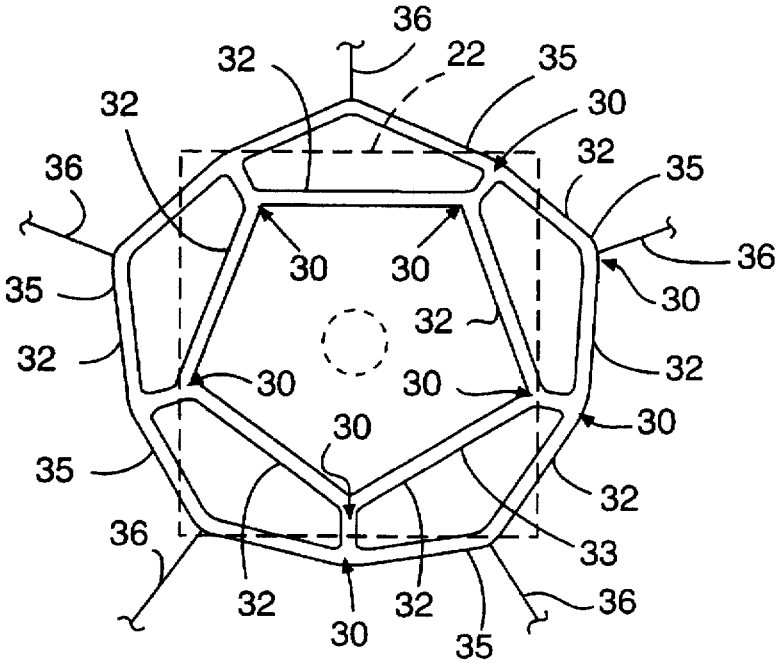
FIG. 2 is a plan view of the floating structure shown in FIG. 1.
Figure 2A:
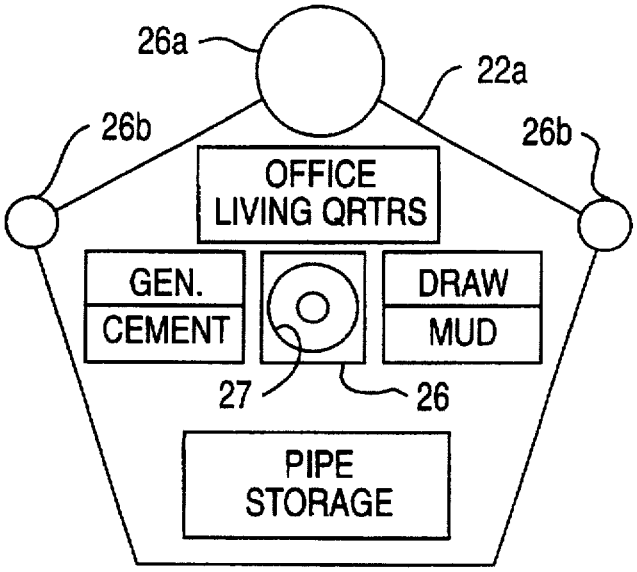
FIG. 2A is a plan view of a first alternate embodiment of a platform for the floating structure shown in FIG. 1.

Referring briefly to FIG. 2A, a platform for the floating structure 20, as well as the structure to be described below in conjunction with FIG. 5, may be a pentagonal shaped platform 22a rather than the rectangular platform 22 shown in FIGS. 1 and 2. The platform 22a may have components arranged in a layout as shown with a helicopter landing deck 26a disposed above one of the Y-joints 30 at one of the corners of the space frame 33 with cranes 26b located at respective opposite corners, also above respective Y-joints 30, and a derrick 26 generally centered on the platform 22a as illustrated. A suitable moon pool opening 27 is provided in the platform 22a as shown. An office and living quarters structure 26c is disposed where indicated and placement of components such as generators, drawworks, cement storage tanks, mud tanks and pipe storage racks may be arranged as illustrated in FIG. 2A.

Figure 2B:
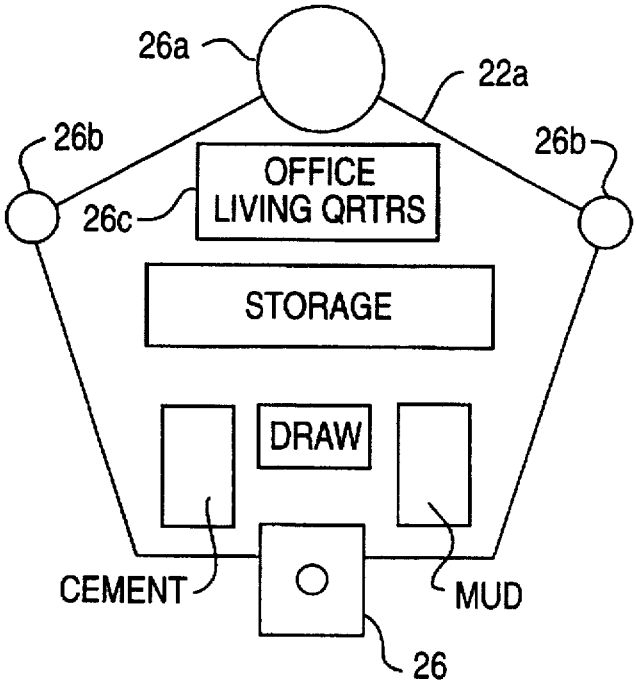
FIG. 2B is a plan view of a second alternate embodiment of a platform for the floating structure shown in FIG. 1.

FIG. 2B shows yet another arrangement of a platform 22a similar in some respects to the platform shown in FIG. 2A but more suited to an arrangement for exploratory drilling wherein the derrick 26 is cantilevered out from one side of the platform and suitably supported thereon with storage for pipe and other equipment, cement tanks, mud tanks and drawworks disposed where indicated.

Figure 5:
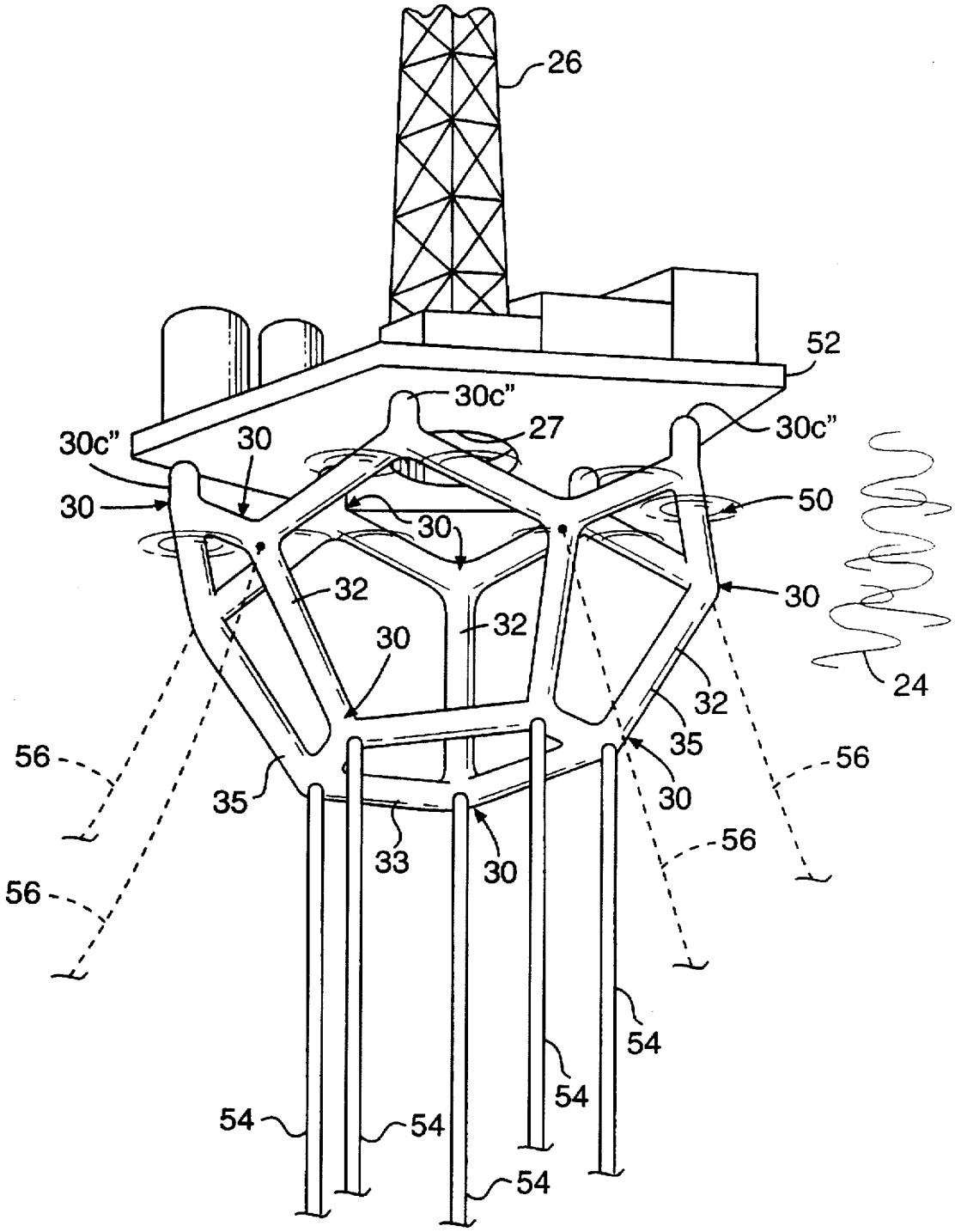
FIG. 5 is a perspective view of a first alternate embodiment of a floating structure, also particularly adapted for supporting an offshore drilling and/or production platform, in accordance with the invention.

Referring now to FIG. 5, there is shown a modified floating structure, generally designated by the numeral 50, which is similar in many respects to the floating structure 20. The structure 50 may, in fact be the truncated dodecahedral structure 20, but substantially inverted so that the bottom pentagonal space frame 33 forms a submerged generally horizontal portion of the structure 50 with upwardly extending leg portions 32 formed by the space frames 35 terminating at uppermost Y-joints 30 having arm portions 30c" adapted to support a deck or platform structure, generally designated by the numeral 52. The platform or deck 52 may also be adapted to be operable as a drilling and/or production platform, including a suitable derrick 26 mounted thereon and centered over a moon pool opening 27 formed in the platform, as shown. Other structure and apparatus, useful in drilling and producing hydrocarbon fluids, may be disposed on the platform 52 in a conventional manner. The platform 52 is suitably secured to the upwardly projecting arms 30c" of the Y-joints 30, as shown.

The structure 50 is also adapted to form flotation chambers within the legs 32 of the space frames 33 and 35 in substantially the same manner as the structure 20. Suitable compartments or ballast tanks may be provided in the legs 32 of the space frame 33 to add stability to the structure when floating in the sea.

The structure 50 may be anchored to the seabed by conventional tension legs or risers 54 connected to respective ones of the Y-joints 30 of the space frame 33, as illustrated and anchored to the seabed in a conventional manner, not shown. Alternatively or in addition to the anchor means provided by the tension legs or risers 54, the structure 50 may also be anchored by flexible anchor lines or catenary anchor leg chains 56, four illustrated in FIG. 5, and connected to respective ones of Y-joints 30 as shown and to the seabed by suitable anchor means, not shown.

Those skilled in the art will appreciate from the foregoing description that a unique semi-submersible, movable, floating structure may be fabricated using the Y-joint described above and preferably formed of interconnected space frames such as the space frames 33 and 35. The frames 33 and 35, when constructed of hollow tubular members, either circular or of other cross-sectional configurations, may form a unique floating structure which is easily fabricated and has a high degree of stability when put to use either in transit or when held stationary by anchor means of the type described herein.

Figure 13:
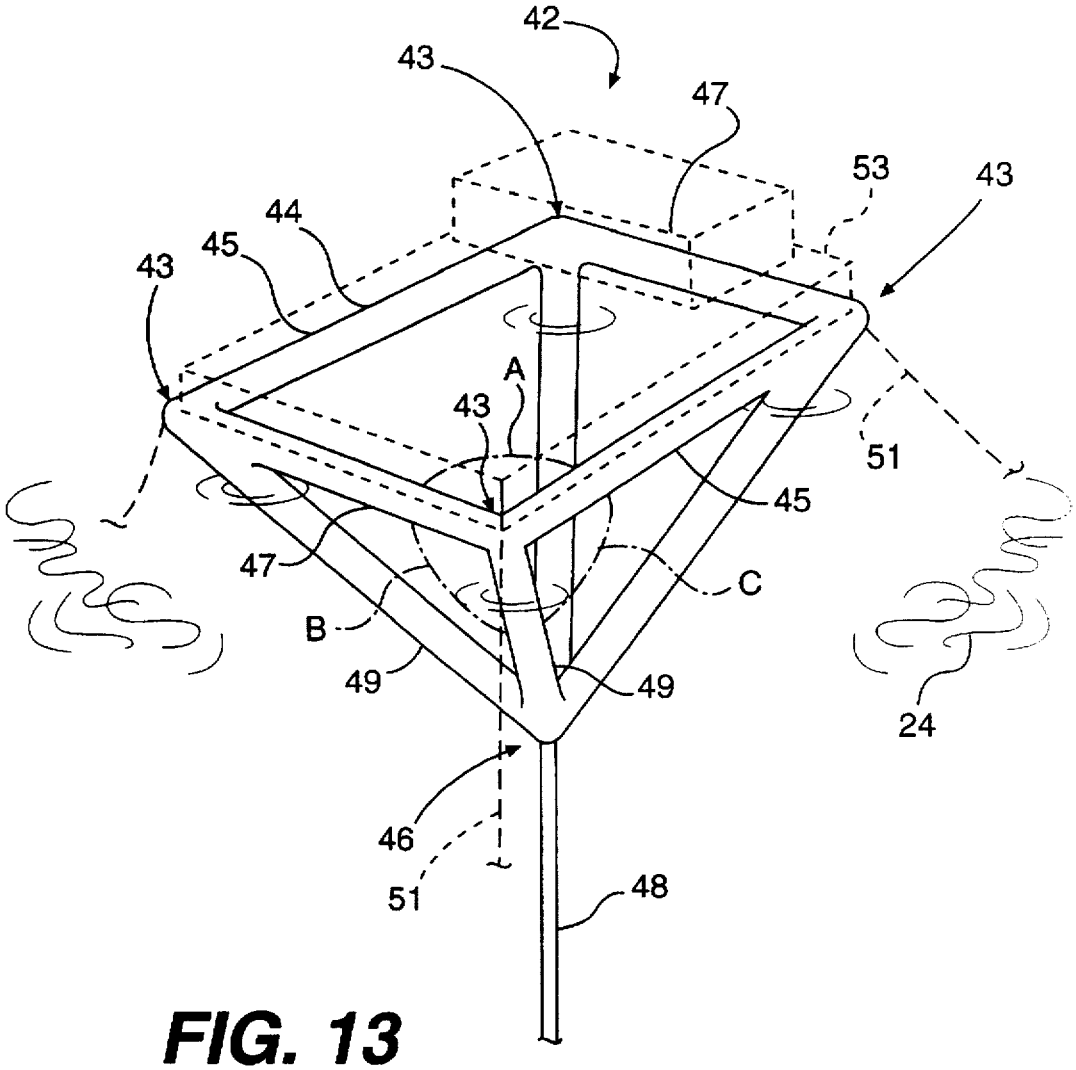
FIG. 13 is a perspective view of a second alternate embodiment of a floating structure, also adapted for supporting an offshore platform.

Referring now to FIG. 13, another embodiment of a floating structure in accordance with the invention is illustrated and generally designated by the numeral 42. The floating structure 42 is of a generally inverted pyramidal configuration and is made up of four Y-shaped joints 43 at the respective corners of a space frame 44. Each of the Y-shaped joints 43 is formed to have hollow tubular segments or arms in the same manner as the joints 30 and may include branch portions 45, 47 and 49. The branch portions 45 and 47 interconnect with other Y-joints 43 and the branch portions 49 descend to a quadrajoint 46 at the tip of the floating structure 42, as shown. The floating structure 42 may be anchored by a hollow tubular tension leg or riser member 48 and by catenary anchor leg members 51 extending from each Y-shaped joint 43. The floating structure 42 is adapted to support a platform 53 thereon above the surface of the sea 24. The Y-joints 43 are formed with respective angles A, B and C between the respective branch portions wherein the angle A between branch portions 45 and 47 is 90°, the angle B between branch portions 47 and 49 is 60° and the angle C between branch portions 45 and 49 is 60°. The Y-shaped joints 43 may be constructed in substantially the same manner as the Y-shaped joints 30 and the depending legs 49 may be configured to form flotation and ballast chambers for the floating structure 42. The platform 53 may have a similar array of components, including a derrick 26, as the platform 22.

Figure 15:
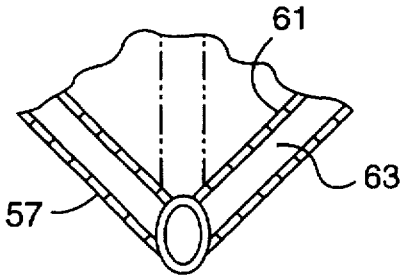
FIG. 15 is a detail section view taken from the line 15—15 of FIG. 14.
Figure 14:
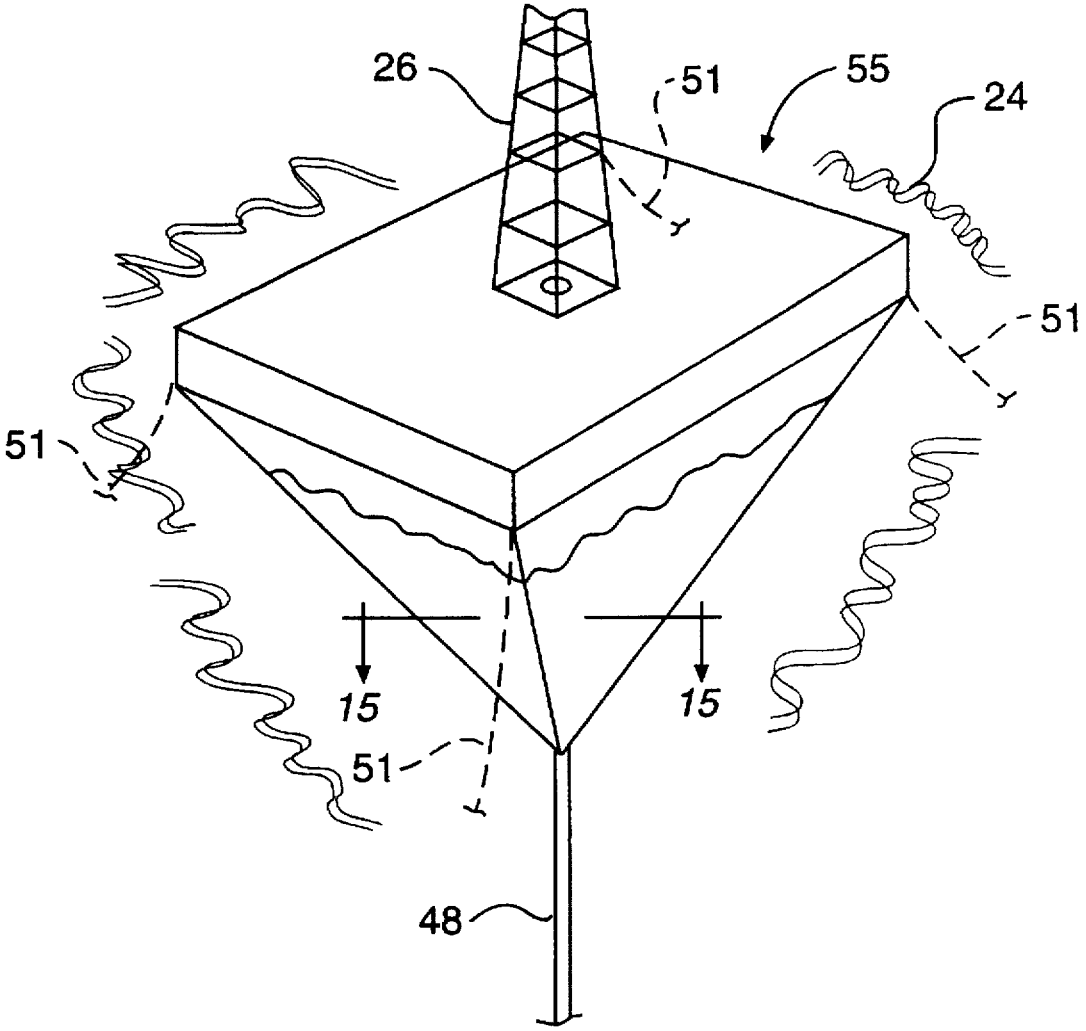
FIG. 14 is a perspective view of a third alternate embodiment of a floating structure in accordance with the invention.

Referring now to FIGS. 14 and 15, another inverted pyramidal floating structure embodiment is illustrated and generally designated by the numeral 55. The floating structure 55 may be made up of the same Y-shaped joint configuration as used for the floating structure 42, or the Y-shaped joints may be formed of back-to-back or face-to-face channel sections as will be described in further detail herein and wherein the space frames made up of the Y-shaped joints and interconnecting legs are covered by an outer skin 57, see FIG. 15, and an inner skin 61 to form a closable space 63 which may serve as a flotation chamber for the structure 55. The structure 55 may also be anchored by a tension leg or riser member 48 and flexible anchor legs 51 at each corner of the structure. The structure 55 may also support suitable means, such as a derrick 26, for performing operations offshore to drill and produce fluids from subterranean wells beneath the seabed 28.

Figure 16:
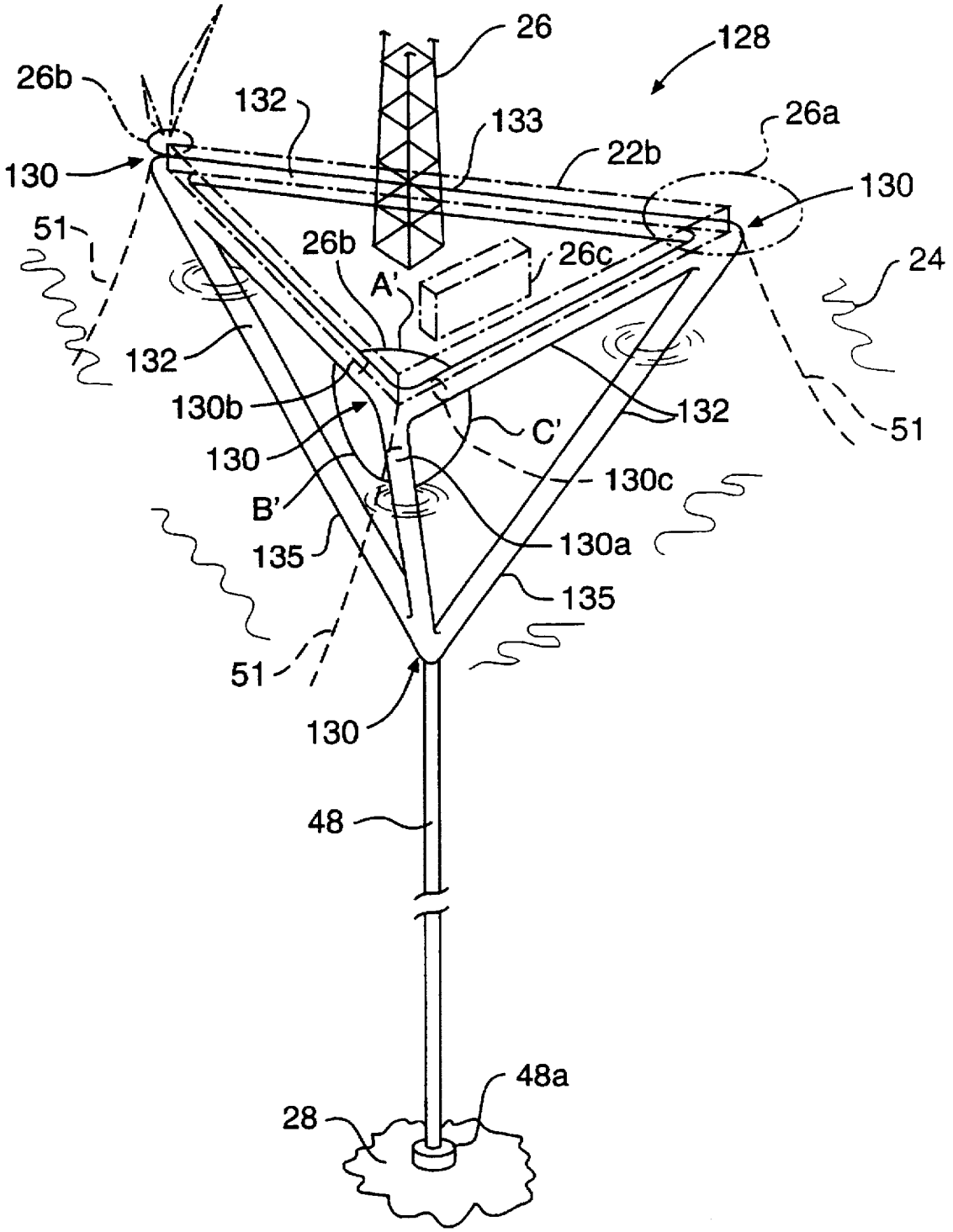
FIG. 16 is a perspective view of a fourth alternate embodiment of a floating structure in accordance with the invention.

Referring to FIG. 16, another pyramidal floating structure is illustrated and generally designated by the numeral 128. The floating structure 128 is configured in the form of a tetrahedron having four Y-shaped joints 130 similar to the Y-shaped joints 30 but having angles between their respective branch portions of 60° rather than the angle of 108° as shown for the structure 20. Cylindrical tubular leg members 132 interconnect the Y-joints 130, are all of equal length and, when interconnected as shown in FIG. 16., form a generally horizontally disposed space frame 133 and three dependent space frames 135. The lowermost Y-joint 130 is connected to a hollow tubular riser or tension leg 48 which may be connected to a subsea wellhead or blowout preventer system **48*a*. Catenary or taut anchor legs 51 extend from each of the Y-joints 130 except the lowermost Y-joint which is connected to the riser 48**.

The floating structure 128 is operable to support a platform **22*b* having a derrick 26 disposed thereon, preferably aligned with riser 48 for performing operations therethrough, and an arrangement of a helicopter landing deck 26*a*, one or more cranes 26*b* disposed above the Y-joints 130 and office and living quarters 26*c* supported on the platform. As shown in FIG. 16 angles A', B' and C' are formed between adjacent legs or branch portions 130*a*, 130*b* and 130*c* of the Y-joint 130**. These angles, as mentioned, are preferably 60°.

The Y-shaped joints 30, 43 and 130 and the interconnecting legs associated with each may also be constructed of reinforced plastic or composite materials as well as materials which are generally flexible and require internal inflation to form a rigid joint and interconnecting leg portion. Accordingly, the Y-shaped joints of the present invention may be constructed in accordance with the teaching of my U.S. Pat. No. 4,288,947. Still further, the joints 30 and 43 may be formed of a flexible fabric reinforced elastomeric material which would require constant inflation pressure to maintain the rigidity of the structure but the structure may be deflated to aid in towing to and from its working position. In this regard, the inflatable joints 30 and the interconnecting legs 32, for example, may be connected to a platform structure which itself is a buoyant vessel. The platforms 22, **22*a* and 22*b*, for example, may comprise barge-like vessels which would be suitably buoyant to move to and from a work site but operable to be positioned above the surface of the sea 24** at the target location and supported by their structures, respectively, once the structures are inflated to a suitable working pressure which would form the rigid joints and the interconnecting legs. After operations are completed such structures can be removed with minimum impact on the environment.

Referring now to FIG. 17, another embodiment of a floating structure in accordance with the invention and suitable for supporting a drilling or production platform is illustrated and generally designated by the numeral 140. The floating structure 140 may be made up of a plurality of pentagonal space frames 142 and **142*a* and hexagonal space frames 144, which are interconnected by Y-shaped joints 146 to be described in further detail herein. The joints 146 interconnect and may form part of respective frame legs 148 of each of the space frames 142, 142*a* and 144 to form a structure with depending legs and frames which will form supporting flotation for a pentagonal platform 150 to be supported on the space frame 142*a*. The space frame 142*a* is disposed in the plane of the paper of FIG. 17. The space frames 144 and the space frames 142 depend into the plane of the paper in the view of FIG. 17. Each of the lowermost joints 146 of the floating structure 140 of FIG. 17 may be connected to respective catenary or taut anchor legs 36, as shown, pairs of which may be suitably connected to anchor means 38 in a manner similar to the embodiments of FIGS. 1 and 16, for example. The pentagonal space frames 142 may be omitted from the floating structure 140, depending on the flotation requirements, for example, and the anchor legs 36 may be connected to the Y-joints 146 at the bases of the space frames 144. This latter arrangement is indicated in FIG. 17 by alternate position lines for the anchor legs 36. Only five anchors 38** are required for either arrangement.

Referring now to FIG. 18, an embodiment of a floating structure is illustrated and generally designated by the numeral 151 which includes a hexagonal, generally horizontally disposed space frame 152 and depending hexagonal frames 154 having pentagonal space frames 156 interposed therebetween and contiguous with the space frame 152. The floating structure 151 of FIG. 18 is thus made up of four hexagonal space frames and three pentagonal space frames, as shown. The floating structure 151 may also utilize Y-shaped joints 146 and connecting leg members 148 throughout and the lowermost joints 146 of the structure 151 are also connected to respective anchor legs 36, as illustrated. Only representative ones of joints 146 and legs 148 are designated in FIGS. 17 and 18. The space frame 152 is disposed in the plane of the paper in FIG. 18 and is operable to support a suitable platform 153 thereon in a manner similar to the way in which the floating structures 20, 42, 50, 128 and 140 support platforms thereon, respectively. The legs 148 of structure 151 may be made up of branch portions of the Y-shaped joints 146 and cooperating coupling means to be described in more detail hereinbelow.

Figure 19:
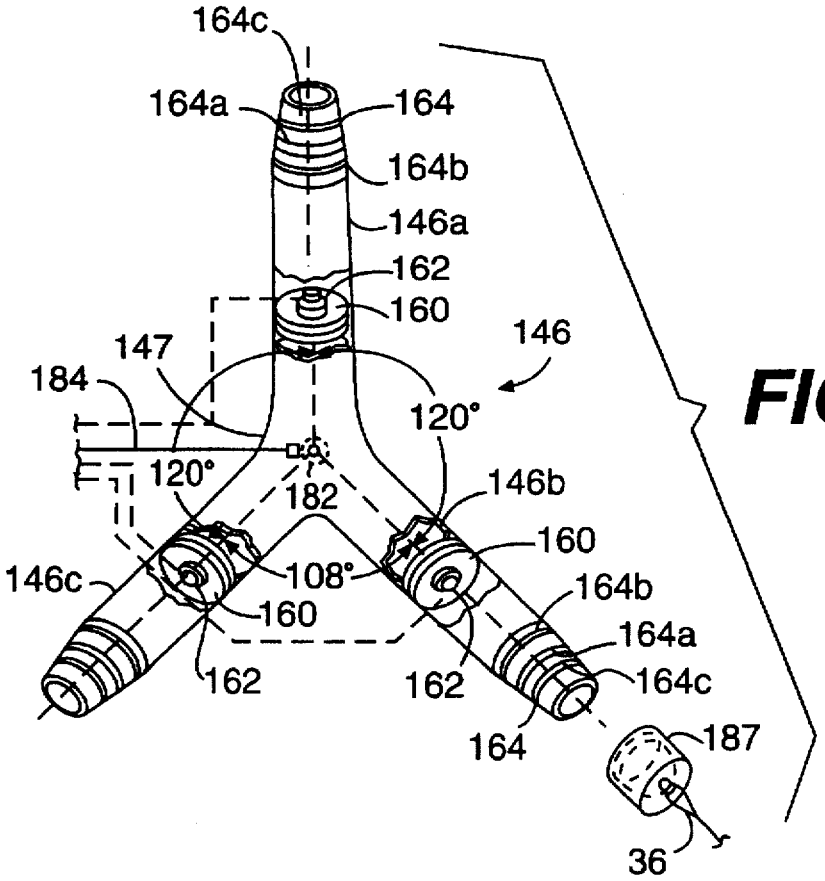
FIG. 19 is a view of a Y-shaped joint adapted for use with several embodiments of the floating structures in accordance with the invention.

Referring now to FIG. 19, a Y-shaped joint 146 is shown in detail and is characterized by three separate branch portions **146*a*, 146*b* and 146*c* which are suitably integrally joined together and form angles with respect to each other of 120°, 108° and 120°, as shown in the drawing figure. These angles are measured from the central axes of each of the branch portions 146*a*, 146*b* and 146*c*, as illustrated. Each of the branch portions of the joint 146 is provided with a suitable transverse bulkhead 160 having a remotely controllable fluid control valve 162 interposed therein as shown. The distal ends of the branch portions 146*a*, 146*b* and 146*c* are provided with coupler members 164, which comprise frustoconical tapered sleeves. The tapered coupler members 164 include transverse shoulder portions 164*a* and spaced apart circumferential grooves 164*b* and 164*c* formed therein, respectively. The tapered members 164 are preferably integrally formed with the branch portions 146*a*, 146*b* and 146*c*, respectively, in the embodiment of the Y-shaped joint, as shown in FIG. 19. Alternatively the coupler members 164, and alternate embodiments described below may be formed separate from and then bonded to tubular branch portions 146***a*, 146*b* and 146*c*.

Figure 20A:
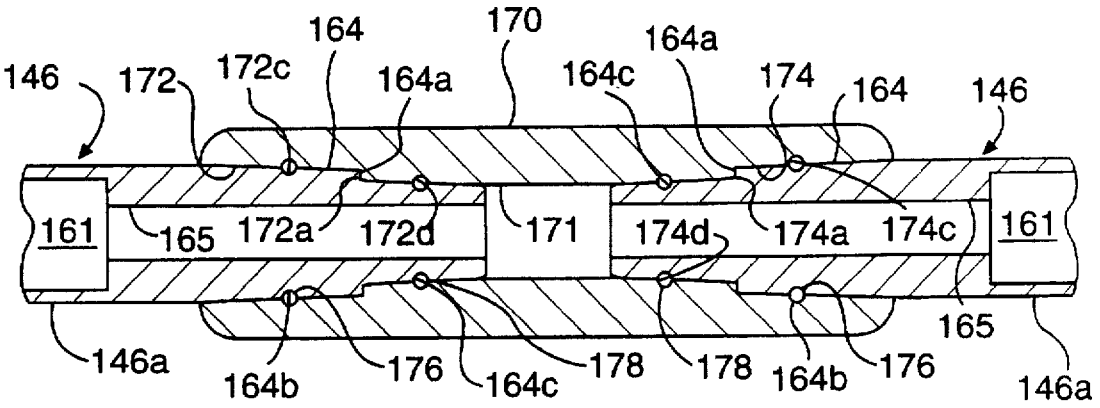
FIG. 20A is a detail section view showing one embodiment of a connection between Y-shaped joints of the type shown in FIG. 19.
Figure 20B:
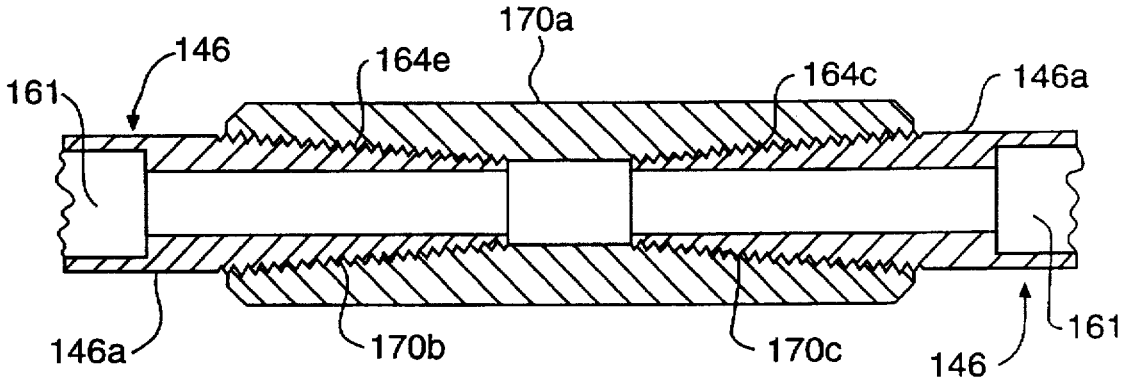
FIG. 20B is a detail section view of an alternate embodiment of a connection between Y-shaped joints of the general type shown in FIG. 19.
Figure 20C:
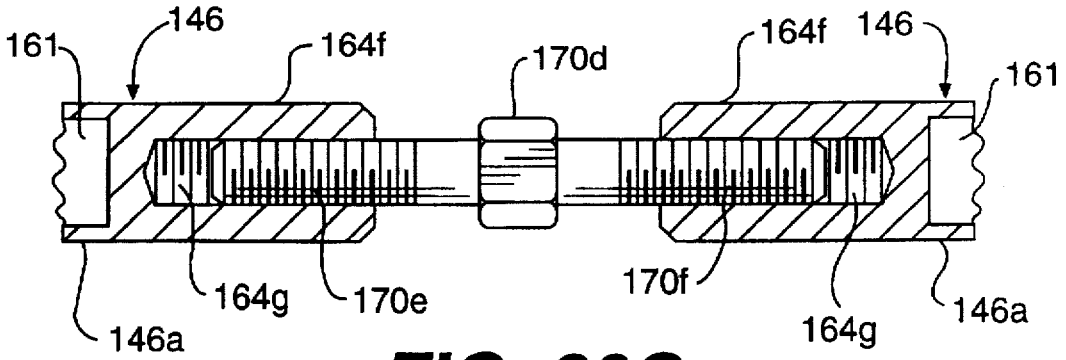
FIG. 20C is a detail section view of a second alternate embodiment of a connection between Y-shaped joints of the general type shown in FIG. 19.

Each of the legs 148 of the space frames of the floating structures 140 and 151 may be made up of structure as shown in FIGS. 20A, 20B and 20C, respectively. Referring to FIG. 20A, for example, interconnected legs or branch portions of two adjacent Y-shaped joints 146 are shown and each designated by numeral 146*a*, respectively. The tapered coupler members or sleeves 164 of each branch portion 146*a* are shown connected to a coupler member 170 comprising an elongated cylindrical sleeve having opposed coaxial tapered bores 172 and 174 formed therein. Transverse shoulder portions 172*a* and 174*a* are formed in the member 170 and cooperate with and engage the transverse shoulder portions 164*a* of the sleeves 164. Spaced apart circumferential grooves 172*c*, 172*d*, 174*c* and 174*d* are also formed in the tapered bores 172 and 174, respectively. The coupler tapered surfaces, the surfaces 164*a* and grooves 164*b* and 164*c* and the surfaces 172, 172*a*, 174, 174*a* and grooves 172*c*, 172*d*, 174*c* and 174*d* may be machine finished.

Resilient cylindrical O-ring type seal and connector members 176 and 178 are disposed in the cooperating sets of grooves, as shown in FIG. 20A. By way of example, one of the ring members 176 is disposed in cooperating grooves 172*c* and 164*b* and one of the ring members 178 is disposed in the cooperating grooves 164*c* and 172*d*. When a coupler sleeve 164 is inserted in a bore of a coupler member 170, it is locked in place as shown in FIG. 20A by the engagement of the ring members 176 and 178 in registration with the respective sets of grooves as shown and described. In this way, a simplified interconnection of the Y-shaped joints 146 may be carried out using a coupler arrangement as shown and described in conjunction with FIG. 20A. The coupler sleeves 164 include axial bores 165 which communicate with the interior chambers 161 of the branch portions 146*a* of the Y-shaped joints 146, respectively. A connecting bore portion 171 interconnects the tapered bores 172 and 174 to provide a continuous passage for pressure fluid during inflation and deflation of the Y-shaped joints and the connecting leg portions.

As will be appreciated from the foregoing description, each leg 148 of floating structure 140, for example, may be made up of a coupler member 170 and cooperating respective branch portions of Y joints 146.

Referring now to FIG. 20B, there is shown an alternate embodiment of a connection between adjacent Y-shaped joints 146 wherein the branch portions of the joints are modified to include tapered, externally threaded coupler members 164*e* on each of the branch portions 146*a*, 146*b* and 146*c*. Two adjacent branch portions 146*a* are illustrated with the modified tapered coupler members 164*e*. Cooperating threaded coupler member 170*a* is illustrated comprising a generally cylindrical tubular member with opposed sets of internal threads 170*b* and 170*c* adapted for threadedly engaging the members 164*e* in substantially fluid tight relationship thereto. Accordingly, with the embodiment of FIG. 20B, a leg 148, for example, of a space frame 142 would be made up of the modified branch portions 146*a*, 146*b* or 146*c* interconnected by a coupler 170*a*. The hand of the threads on the respective coupler members 170*a* and the tapered members 164*e* would require to be such as to allow for tensioning the branch portions 146*a*, 146*b* or 146*c* as the joints are made up to form the legs 148 upon rotation of the coupler 170*a* to form the coupling between adjacent Y-shaped joints.

Referring now to FIG. 20C, another embodiment of a Y-shaped joint 146 is shown wherein the branch portions, such as cooperating branch portions 146*a* of each of two joints, as shown, are formed with distal end coupler members 164*f* which are internally threaded at 164*g*, for example, and cooperate with a coupler member 170*d* having opposed externally threaded portions 170*e* and 170*f*, respectively, threadedly engaged with the distal end portions of the Y-shaped joints for adjusting the tension between the joints and for making up the legs 148, for example.

Referring again to FIG. 19, each Y-shaped joint 146 includes a fluid fill and vent valve 182 connected to the joint at a tubular base part 147 and suitably connected to a source of pressure fluid, such as compressed air, via a supply conduit 184. Each of valves 162 and 182 may be remotely controllable to provide for pressurizing the joints 146, including the portions thereof forming the legs 148, by valving pressure fluid, such as compressed air, into a joint base 147 and then into each of the branch portions 146*a*, 146*b* and 146*c*. By selectively valving pressure fluid into and out of interior spaces 161 of Y-shaped joint branch portions, the Y-shaped joints 146 themselves may be caused to be erect and rigid or to be allowed to collapse so that the space frames of the structures 140 and 151 may be selectively collapsed to allow for towing the floating structures with reduced drag, to alter the draft of the structures or to alter the freeboard of the platforms 150 and 153, as desired. Valves 162 may vent pressure air from the chambers or spaces 161 formed between the bulkheads 160 and the coupler members 170, 170*a* or 170*d* for each leg 148 or a portion of each leg, depending on which Y-shaped joints are controlled to valve pressure fluid to and from the respective chambers. The chambers 161 of each branch of each Y-shaped joint may terminate at a transverse end wall in the coupler member portions of each Y-shaped joint.

FIG. 19 also illustrates an anchor leg connector member 187 which is suitably connected to an appropriate branch of a joint 146 in the same manner as the connection formed by a coupler member 164, 164*e* or 164*f* to provide a connection for an anchor leg 36. Those skilled in the art will appreciate that the floating structures 20, 42, 50 and 128 may also be modified to include Y-shaped joints substantially like the joints 146 and utilizing connecting legs substantially like the legs 148. As mentioned previously, the Y-shaped joints 146 may be formed of a fabric reinforced flexible polymer material, such as urethane coated polyvinyl chloride, which is durable and airtight. The coupler members 170, 170*a*, for example, may also be formed of the same or a similar material. The Y-shaped joints 30, 43, 130 and 146 and the connecting leg of each of the associated floating structures may be adapted to provide temporary storage of production fluids, such as crude oil, for example, prior to transferring such fluids to a tanker or via pipeline to a shoreside facility.

Figure 6:
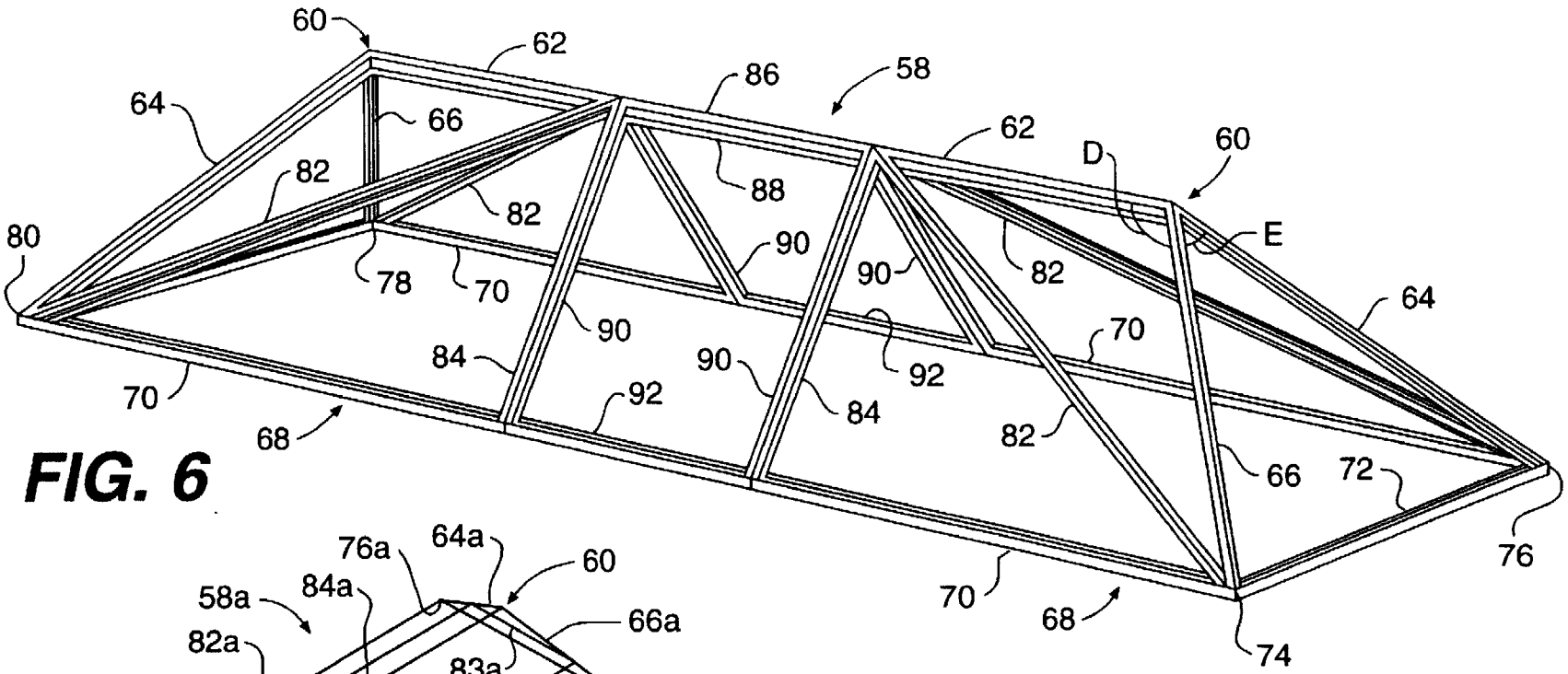
FIG. 6 is a perspective view of a roof structure utilizing the improve Y-shaped joint of the present invention.

Modular structures utilizing a Y-joint of the present invention may also include roof structures. Referring to FIG. 6, for example, a modular roof structure is illustrated and generally designated by the numeral 58. The roof structure 58 includes at least two Y-joints 60 fabricated in accordance with the present invention in a manner to be described herein. The roof structure 58 is a so-called hip-type structure wherein the Y-joints 60 form at least a portion of a ridge beam 62 and depending corner beams 64 and 66, respectively. The beams 64 and 66 depend to and terminate at a base frame 68, preferably characterized by elongated parallel upwardly facing channel members 70 and a transverse channel member 72. The corners 74, 76, 78 and 80 formed by intersections of the base frame members 70 and 72 receive the depending ends of the beams 64 and 66 and are suitably secured thereto as by welding or suitable mechanical connectors, not shown.

As shown in FIG. 6, the roof structure 58 may include suitable channel or angle cross section intermediate rafters or braces 82 and 84 suitably secured to the branches 62, 64 and 66 by welding or by conventional high strength bolts, not shown. The roof structure 58 may be modular in the sense that intermediate roof sections may be added to the roof structure 58 to increase its span. One modular section 86 is illustrated in FIG. 6 and includes a ridge beam member 88, depending rafters or beams 90 and generally horizontal base frame members 92. The roof section 86 may be secured to the roof sections formed by the Y-joints 60 by conventional mechanical fasteners, not shown, or welding, if appropriate metals are used for the members 62, 70, 84, 86 and 92, for example.

As with the Y-joints 30, the Y-joints 60 may be formed in such a way that two adjacent branches, such as the branches or arms 62, 64 and 66 form an angle of about 108° with respect to each other. As shown in FIG. 6, for example, the angle D between the branches or arms 62 and 66, the angle E between the branches or arms 64 and 66 and the angle F, not shown, between the branches or arms 62 and 64 are each 108°.

Figure 6A:
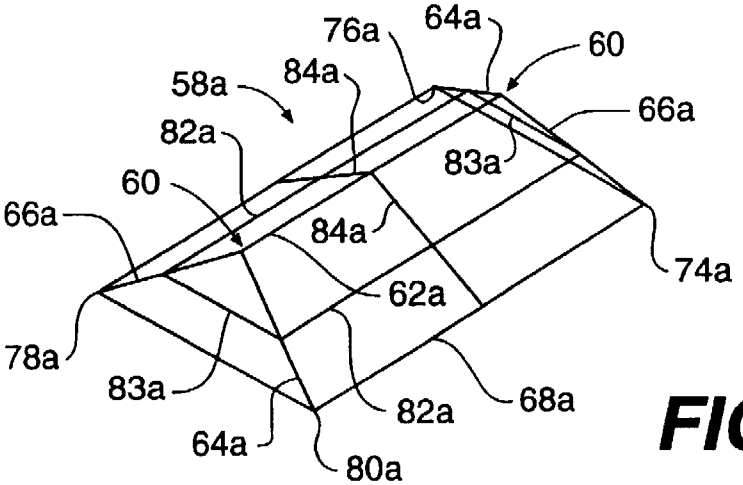
FIG. 6A is a perspective view, in somewhat schematic form, of an alternate embodiment of a roof structure utilizing the Y-shaped joints.

FIG. 6A illustrates a modified hip roof utilizing Y joints 60. The roof structure shown in FIG. 6A is generally designated by the numeral 58*a* and may include suitable channel or angle cross section members making up a ridge beam 62*a* and depending corner beams 64*a* and 66*a* which terminate at a base frame 68*a*. Corners 74*a*, 76*a*, 78*a* and 80*a* receive the depending ends of the beams 64*a* and 66*a* in the same manner as the roof structure 58.

FIG. 6A illustrates significant differences between the roof structure 58*a* and the roof structure 58, namely, a hoop purlin structure interconnecting the beams 64*a* and 66*a* including elongated longitudinal purlins 82*a* and transverse purlins 83*a*. The purlin members 83*a* and 82*a* form a continuous hoop purlin. The purlins 82*a* are connected to a center arch formed by opposed beam members 84*a* which depend from the ridge beams 62*a* to the base frame 68*a*, as shown.

Figure 7:
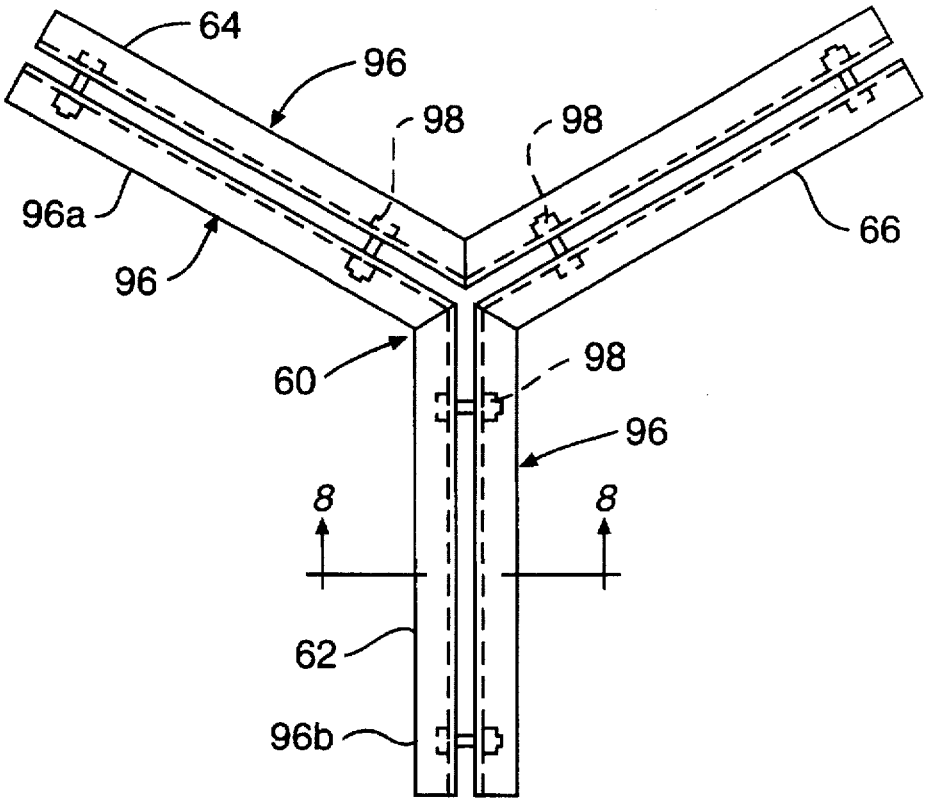
FIG. 7 is a detail plan view of a Y-shaped joint using branch members fabricated in accordance with the invention.
Figure 8:
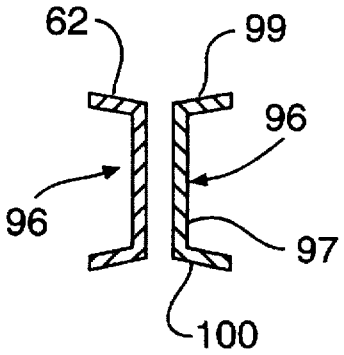
FIG. 8 is a detail section view taken from the line 8—8 of FIG. 7.

Referring now to FIGS. 7 and 8, a preferred embodiment of one of the Y-joints 60 is illustrated wherein the Y-joint is fabricated from three opposed channel members 96 which may be secured together by suitable mechanical fasteners 98, as shown, to form the Y-joint 60 and its respective branches or arms 62, 64 and 66. In FIGS. 6, 7 and 8, the channel members 96 are shown spaced slightly apart to illustrate how they can be assembled by the fasteners 98 to be contiguous with each other along the respective branches or arms, 62, 64 and 66. The channel members 96 may also be secured together by welding or other suitable means.

Figure 11:
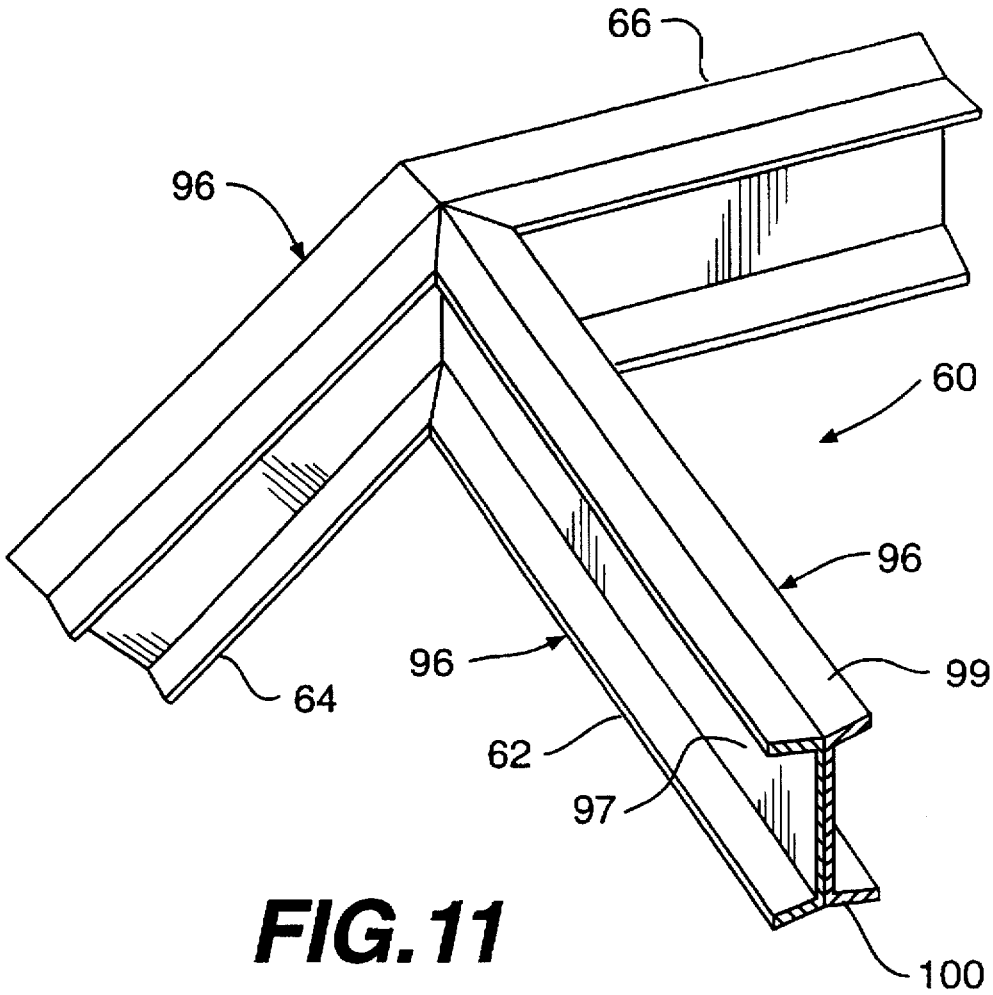
FIG. 11 is a perspective view of a rigid Y-shaped joint in accordance with one embodiment of the invention.

FIG. 8 shows one preferred cross-sectional configuration of the channel members 96 wherein each channel member has a web 97 and opposed flanges 99 and 100 extending substantially normal to the web. Suitable spaced apart holes may be formed in the web 97 to receive the fastener assemblies 98, FIG. 7, which may comprise conventional field bolt and nut assemblies, for securing the channels 96 to each other to form a rigid Y-joint. An assembled Y-joint 60 is shown in FIG. 11 wherein the joint has been welded along the contiguous edges of the channels 96 rather than secured by mechanical fasteners. The angles formed between the branches or arms 62, 64 and 66 are exaggerated somewhat in the views of FIGS. 11 and 12 in the interest of illustrating the structure.

Figure 9:
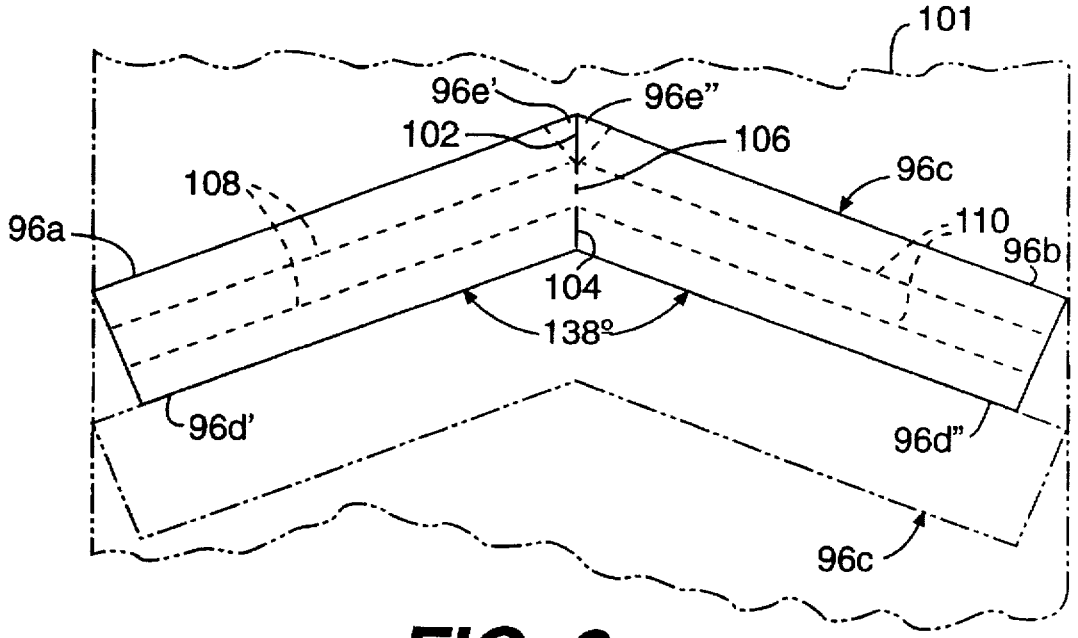
FIG. 9 is a developed plan view of one of the branch members of the improved Y-shaped joint of the invention.

One preferred configuration of the Y-joints 60 using the channel members 96 is characterized by the channel members being formed from a single piece of substantially flat plate 101, for example, see FIG. 9. In other words, each channel 96 is formed of an integral part which is suitably bent to form the web 97 and flanges 99 and 100 and then also bent in a direction to form opposed branches or arm portions 96*a* and 96*b* of each channel member. FIG. 9 is a plan view showing flat plate 96*c* cut or stamped form plate 101 and from which a channel member 96 may be formed. The plate is a chevron-shaped member having opposed flat branches 96*d*' and 96*d*". Plural plates 96*c* may be cut from larger plate 101 and then further cut along coincident lines 102 and 104 leaving an integral web portion 106 therebetween. The plate 96*c* may then be folded along parallel fold line 108 for branch 96*d*' and parallel fold lines 110 for branch 96*d*" to form the flanges 99 and 100 and the intervening web 97 on the respective branches 96*a* and 96*b* of each channel. For a Y-joint 60 having angles between adjacent branches or arms 62, 64 and 66 of 108° the included angle between the branches 96*d*' and 96*d*" may be about 138°, as shown in FIG. 9.

If the channel members 96 are to be formed such that the branches or arm portions 96*a* and 96*b* will be mounted back-to-back to form the arms 62, 64 and 66, that is with the flanges 99 and 100 of each channel facing away from the same flanges of a contiguous channel, small triangular shaped plate portions of the branches 96*d*' and 96*d*" indicated by numerals 96*e*' and 96*e*" will be required to be cut away, as shown in FIG. 9, so that the channel branches 96*d*' and 96*d*" may be folded along line 106 to form branches 96*a* and 96*b*, respectively. Alternatively, one of these plate portions may be folded under the other and welded as the branches are folded relative to each other along line 106. This type of fabrication would be required if the flanges 97 and 100 are formed by folding along the fold lines 108 and 110 to cause the flanges to project out of the plane of the paper of FIG. 9 and the flanges 97 are contiguous with each other after folding the cut plate 96*c* at line 106.

Figure 12:
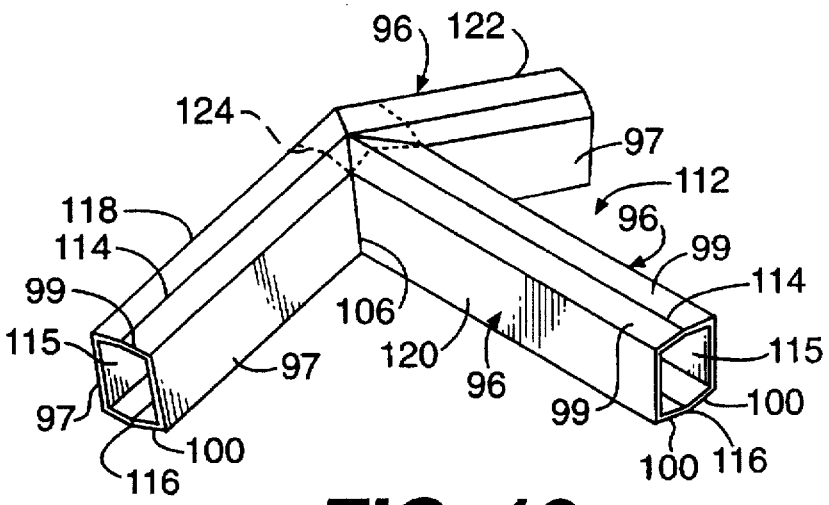
FIG. 12 is a perspective view of a rigid Y-shaped joint in accordance with an alternate embodiment of such joint of the invention.

Referring now to FIG. 12, if the channel members 96 are folded in the opposite direction from that just described, but also along fold line 106, respectively, the flanges 99 and 100 may be joined in abutting relationship, as shown, to form closed interior spaces 115 between the channel members 96 along each branch of a Y-shaped joint, generally designated by the numeral 112 in FIG. 12. The flanges 99 and 100 may be secured to each other by welding along weld lines 114 and 116, for example, to form a closed tubular Y-shaped joint. If the channel sections 96 are formed according to the process described above, and using a plate member as shown in FIG. 9, an additional closure plate member may be required at the juncture of the joint branches or arms, such as the arms 118, 120 and 122. Such a closure plate is illustrated in FIG. 12 and designated by the numeral 124. A closure plate, not shown, on the opposite side of the juncture of the branches or arms 118, 120 and 122 will also be required. Alternatively, the channel sections forming a Y-joint, such as the Y-joint 112, may be prefabricated to have the contiguous edges at the juncture of the branches 118, 120 and 122, match each other without a gap so that the welds formed along the lines 114 and 116 of each branch may meet at the juncture of the branches of the joint.

As mentioned previously, the hollow, tubular Y-shaped joint 112 may be used in place of the cylindrical tubular Y-shaped joints 30 for a floating structure, such as the structures 20 or 50, respectively. The joint 46 may also be formed by four channel sections similar to the channel sections 96 and formed in a manner like that of joint 112, but having four branch portions.

Figure 10:
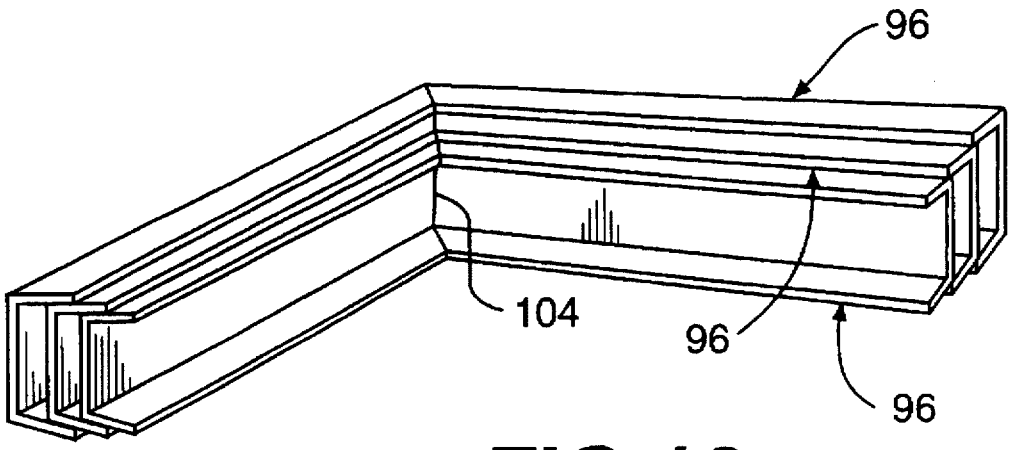
FIG. 10 is a perspective view showing a preferred manner of stacking the unique Y-joint branch members for storage or shipment.

FIG. 10 illustrates a convenient manner in which the channel members 96 of the joint 60 may be nested, one within the other, as shown for ease of storage and transport. Accordingly, the Y-shaped joint 60 made up of channel members 96 folded along fold line 106, or otherwise constructed so that they are mounted back-to-back to form a joint as illustrated in FIGS. 7, 8 and 11, may be prefabricated and stacked adjacent to each other in the manner illustrated in FIG. 10 for reduced space requirements during storage or transport. The lengths of the branches or arm portions of the Y-joints 60 and 112 may be virtually any which are suitable or necessary to build the structure associated therewith and formed thereby. In the roof structure of FIG. 6, for example, the respective branches or arms 62, 64 and 66 extend the entire length of the beam spans required of these members, as illustrated. Although such an arrangement is not required, certain advantages may result from providing the Y-shaped joints 60 in this manner to simplify erection of the structure associated with the joints. As mentioned previously, the joints 30, 46, 60 and 112, as well as components described herein not otherwise specified, may be fabricated of metal suitable for the particular application, such as structural steels or aluminums. Alternatively, the Y-shaped joints may also be fabricated of certain composite or reinforced plastic materials suitable for structural purposes depending on the application and the environment to which the structure is to be exposed. Conventional engineering materials may be utilized in this regard.

Although preferred embodiments of the present invention have been described in detail herein, those skilled in the art will recognize that various substitutions and modifications may be made to the invention without departing from the scope and spirit of the appended claims.

What is claimed is:

1. A floating structure, particularly adapted to support a platform for disposition in a water environment such as an open sea, said floating structure comprising:

a plurality of depending interconnected space frames, each of said space frames comprised of elongated depending legs and plural Y-shaped joints interconnecting said legs, each said Y-shaped joint comprised of a vertex and only three segments, each segment being connected at one end thereof to said vertex and two of said segments being connected at the other ends thereof to corresponding legs in the same space frame, and the third segment being connected to a leg in an adjacent space frame;

anchor means connected to at least some of said space frames for anchoring said structure in the open ocean; and flotation chambers for said floating structure to maintain said floating structure buoyant in the sea, said chambers being associated at least with said legs.

2. The invention set forth in claim 1 wherein:

said floating structure is formed of a generally horizontally extending space frame interconnected with said depending space frames and supporting said platform thereon.

3. The invention set forth in claim 2 wherein:

said space frames are pentagonal having leg portions interconnected by Y-shaped joints and each of said Y-shaped joints has three branch arm portions wherein each of two branch arm portions form an angle of about 108° between each other.

4. The invention set forth in claim 2 wherein:

said depending space frames are triangular having leg portions interconnected by Y-shaped joints and each of said Y-shaped joints has three branch arm portions wherein each of two branch arm portions form an angle of about 60° between each other and a third angle between two branch arm portions of about 90°.

5. The invention set forth in claim 2 wherein:

said depending space frames are pentagonal and hexagonal and have leg portions interconnected by Y-shaped joints, each of said Y-shaped joints has three branch arm portions wherein each of two branch arm portions form an angle of about 120° between each other and a third angle between two branch arm portions of about 108°.

6. The invention set forth in claim 2 wherein:

said space frames defined by said plural Y-shaped joints interconnecting generally horizontally extending leg portions comprise triangles and said floating structure comprises a tetrahedral structure wherein each of said Y-shaped joints is defined by branch portions forming angles of 60° between each other, respectively.

7. The invention set forth in claim 1 wherein:

said anchor means includes one of tension leg members secured to said floating structure and catenary anchor leg members connected to said floating structure at spaced apart points thereon, respectively.

8. The invention set forth in claim 1 wherein:

said floating structure includes a generally horizontally disposed space frame and said depending legs extend from said generally horizontally disposed space frame to Y-shaped joints interconnecting said structure with a platform supported thereby and above the surface of the sea.

9. The invention set forth in claim 1 wherein:

said floating structure forms a pyramid structure having a space frame defined by plural Y-shaped joints interconnecting generally horizontally extending leg portions and depending leg portions.

10. The invention set forth in claim 9 wherein:

said floating structure includes a generally rectangular space frame supporting a platform above said generally horizontally extending leg portions and said depending leg portions extend to a quadrajoint to form an inverted pyramid.

11. The invention set forth in claim 9 wherein:

said floating structure forms a tetrahedron having a triangular space frame disposed generally horizontally for supporting a platform thereon, and said floating structure includes triangular depending space frames extending from said horizontally disposed space frame.

12. The invention set forth in claim 1 wherein:

said floating structure includes one of a generally hexagonal and a generally pentagonal horizontally disposed space frame and said depending legs extend from said horizontally disposed space frame to Y-shaped joints defining at least one of plural pentagonal space frames and plural hexagonal space frames, said space frames further comprising said hollow structural members forming flotation space for said floating structure to maintain said floating structure buoyant in the sea.

13. The invention set forth in claim 12 including:

coupler means extending between said Y-shaped joints comprising cooperating coupler members operable to interconnect respective ones of said branch portions of said Y-shaped joints.

14. The invention set forth in claim 13 wherein:

said coupler members each comprise a coupler sleeve having opposed tapered bores and said Y-shaped joints each have cooperating tapered coupler members operable to be inserted in said sleeve and interconnected with said sleeve by cooperating connecting ring members residing in circumferential grooves formed in said sleeve and in said coupler members of said Y-shaped joints, respectively.

15. The invention set forth in claim 13 wherein:

said coupler means extending between said Y-shaped joints, each comprise a threaded coupling sleeve threadedly engageable with cooperating threaded coupler members formed on respective ones of said branch portions of said Y-shaped joints.

16. The invention set forth in claim 13 wherein:

said coupler means extending between said Y-shaped joints, each comprise a threaded member engageable with cooperating threaded portions of respective ones of said branch portions of said Y-shaped joints.

17. The invention set forth in claim 1 wherein:

said Y-shaped joints and said depending legs are formed of flexible material and said Y-shaped joints and said depending legs are adapted to be filled with pressure fluid to cause said space frames to be substantially rigid and to form flotation chambers for said floating structure.

18. The invention set forth in claim 17 wherein:

said Y-shaped joints include respective branch portions and remotely controllable fluid control valves for valving pressure fluid into and from said legs and said branch portions of said Y-shaped joints to control the erection and rigidity of said space frames, respectively.

19. The invention set forth in claim 1 wherein:

said anchor means includes one of tension leg members, taut anchor leg members and catenary anchor leg members secured to said Y-shaped joints, respectively.

20. The invention set forth in claim 1 wherein:

said floating structure includes an inner and outer skin defining a closable space forming buoyancy means for supporting said floating structure in the sea.

21. The invention set forth in claim 1 wherein said flotation chambers comprise at least part of said depending legs.

22. The invention set forth in claim 1 and further including ballast chambers for said floating structure to maintain said floating structure upright and to lower the center of gravity thereof.

23. The invention set forth in claim 22 wherein said ballast chambers comprise at least part of said depending legs.

* * * * *